US007738818B2

(12) United States Patent
Murakami et al.

(10) Patent No.: US 7,738,818 B2
(45) Date of Patent: Jun. 15, 2010

(54) DEVELOPER SUPPLY CONTAINER

(75) Inventors: Katsuya Murakami, Toride (JP); Nobuo Nakajima, Higashimatsuyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 11/722,140

(22) PCT Filed: May 17, 2006

(86) PCT No.: PCT/JP2006/310279

§ 371 (c)(1),
(2), (4) Date: Jun. 3, 2008

(87) PCT Pub. No.: WO2006/123823

PCT Pub. Date: Nov. 23, 2006

(65) Prior Publication Data

US 2009/0092415 A1 Apr. 9, 2009

(30) Foreign Application Priority Data

May 18, 2005 (JP) ..... 2005-145529

(51) Int. Cl.
*G03G 15/08* (2006.01)

(52) U.S. Cl. ..... 399/258; 399/262

(58) Field of Classification Search ..... 399/258–262; 222/DIG. 1

See application file for complete search history.

(56) References Cited

U.S. PATENT DOCUMENTS

| | | | | |
|---|---|---|---|---|
| 5,579,101 | A | 11/1996 | Omata et al. | 399/114 |
| 6,049,685 | A | 4/2000 | Murakami et al. | 399/263 |
| 6,128,453 | A | 10/2000 | Ban et al. | 399/106 |
| 6,278,853 | B1 | 8/2001 | Ban et al. | 399/109 |
| 6,292,644 | B1 * | 9/2001 | Goto et al. | 399/262 |
| RE38,737 | E | 5/2005 | Ban et al. | 399/106 |
| 6,978,107 | B2 | 12/2005 | Nagashima et al. | 399/262 |
| 7,242,893 | B2 | 7/2007 | Murakami et al. | 399/262 |
| 7,369,798 | B2 * | 5/2008 | Sasae et al. | 399/262 |
| 7,450,890 | B2 * | 11/2008 | Murakami et al. | 399/258 |

FOREIGN PATENT DOCUMENTS

EP 0 805 379 A1 11/1997

(Continued)

OTHER PUBLICATIONS

Japanese Office Action issued Dec. 16, 2008, in Japanese Application No. 2005-145529, and partial English-language translation.

(Continued)

*Primary Examiner*—Hoang Ngo
(74) *Attorney, Agent, or Firm*—Fitzpatrick, Cella, Harper & Scinto

(57) ABSTRACT

In order to stabilize opening/closing operations of an apparatus shutter of a toner receiving apparatus utilizing rotation of a toner supply container, the toner supply container is provided, at a peripheral surface thereof, with a snap lock portion, which is engaged with the apparatus shutter to effect opening/closing operations of the apparatus shutter by rotation of the toner supply container. A release force F(N) required for releasing snap lock engagement of the snap lock portion with the apparatus shutter and an elastic repulsive force P(N) of the snap lock portion are set to satisfy the following relationship:

$P=kF$ where $0.25 \leq k \leq 1$.

4 Claims, 7 Drawing Sheets

FOREIGN PATENT DOCUMENTS

| | | | |
|---|---|---|---|
| JP | 63-86652 | U | 6/1988 |
| JP | 64-51962 | U | 3/1989 |
| JP | 7-44000 | A | 2/1995 |
| JP | 7-181793 | A | 7/1995 |
| JP | 7-199623 | | 8/1995 |
| JP | 9-106165 | | 4/1997 |
| JP | 9-106165 | A | 4/1997 |
| JP | 10-48938 | A | 2/1998 |
| JP | 10-55103 | A | 2/1998 |

OTHER PUBLICATIONS

Japanese Office Action issued Mar. 10, 2009, in Japanese Application No. 2005-145529, and partial English-language translation.

* cited by examiner

DEVELOPER SUPPLY CONTAINER

TECHNICAL FIELD

The present invention relates to a developer supply container for supplying a developer to a developer receiving apparatus. For example, as the developer receiving apparatus, it is possible to use an image forming apparatus for forming an image through electrophotography, such as a copying machine, a facsimile, a printer, etc.

BACKGROUND ART

Conventionally, toner in the form of fine powder is used as a developer for image formation in the image forming apparatus such as an electrophotographic copying machine, a printer or the like. It has been conventional that toner is supplied from a toner supply container set in the image forming apparatus to the image forming apparatus with consumption of the toner in the image forming apparatus.

With respect to such a toner supply container, it is proposed and implemented to keep the toner supply container set within the image forming apparatus, and to discharge the toner gradually.

As such a conventional-type toner supply container, it has been proposed that a toner supply container mounted an the image forming apparatus is rotated to open and close a shutter on the apparatus main assembly side (Japanese Laid-Open Patent Applications Nos. Hei 07-199623, Hei 10-48938, and Hei 10-55103). More specifically, an opening projection for opening the apparatus shutter and a closing projection for closing the apparatus shutter are provided at a peripheral surface of the toner supply container and the toner supply container is rotated to open and close the apparatus shutter in such a state that these projections are configured to interpose the apparatus shutter therebetween.

In order to simplify a constitution for opening and closing the apparatus shutter of the image forming apparatus compared with the above described constitution of the toner supply container, Japanese Laid-Open Utility Model Application No. Sho 63-86652 has proposed a toner supply container, at a peripheral surface thereof, provided with projections for effecting both of opening and closing operations. More specifically, each of two projections provided at both longitudinal end portions of the toner supply container at a peripheral surface is engaged with an associated hole provided in an apparatus shutter of an apparatus main assembly. In such a constitution, the toner supply container is rotationally moved but the apparatus shutter is linearly moved vertically. However, it is difficult to design the constitution so that the projections of the toner supply container are engaged into the holes of the apparatus shutter with reliability. In the case where the projections are forcedly engaged into the holes, there is a possibility of breakage of a shutter mechanism. It is also similarly difficult to ensure such a constitution that the apparatus shutter is pushed up to be reliably closed and the projections of the toner supply container are released from the holes of the apparatus shutter with reliability.

DISCLOSURE OF THE INVENTION

An object of the present invention is to provide a developer supply container capable of properly performing opening and closing operations of a shutter by utilizing rotational movement of the developer supply container.

Another object of the present invention is to provide a developer supply container capable of properly performing re-closure of the shutter and release engagement of the shutter.

According to an aspect of the presentinvention, there is provided a developer supply container which is detachably mountable to a developer receiving apparatus comprising a receiving opening for receiving a developer and a shutter for opening and closing the receiving opening and is settable in the developer receiving apparatus by a setting operation including at least a rotation toward a setting position. The developer supply container comprises a snap lock portion, capable of snap lock engagement with the shutter, for opening and closing the shutter by rotation of the developer supply container. When a release force required for releasing the snap lock engagement of the snap lock portion with the shutter is F(N) and an elastic repulsive force of the snap lock portion is P(N), F(N) and P(N) satisfy the following relationship:

$$P=kF \text{ where } 0.25 \leqq k \leqq 1.$$

These and other objects, features and advantages of the present invention will become more apparent upon a consideration of the following description of the preferred embodiments of the present invention taken in conjunction with the accompanying drawings.

BEST MODE FOR CARRYING OUT THE INVENTION

The preferred embodiments of the present invention will be described in conjunction with the accompanying drawing.

The measurements, materials, and configurations of the structural components, the positional relationship among them, etc., in the preferred embodiments of the present invention, which will be described hereinafter, are to be modified, as necessary, according to the structure of the apparatus to which the present invention is applied, and/or the various conditions under which the apparatus is operated. In other words, they are not intended to limit the scope of the present invention, unless specifically noted.

(Image Forming Apparatus)

First, referring to FIG. 1, an electrophotographic copying machine, as an example of an electrophotographic image forming apparatus in which the toner supply container, as a developer supply container, is mounted, will be described with regard to its structure.

Figure 1:
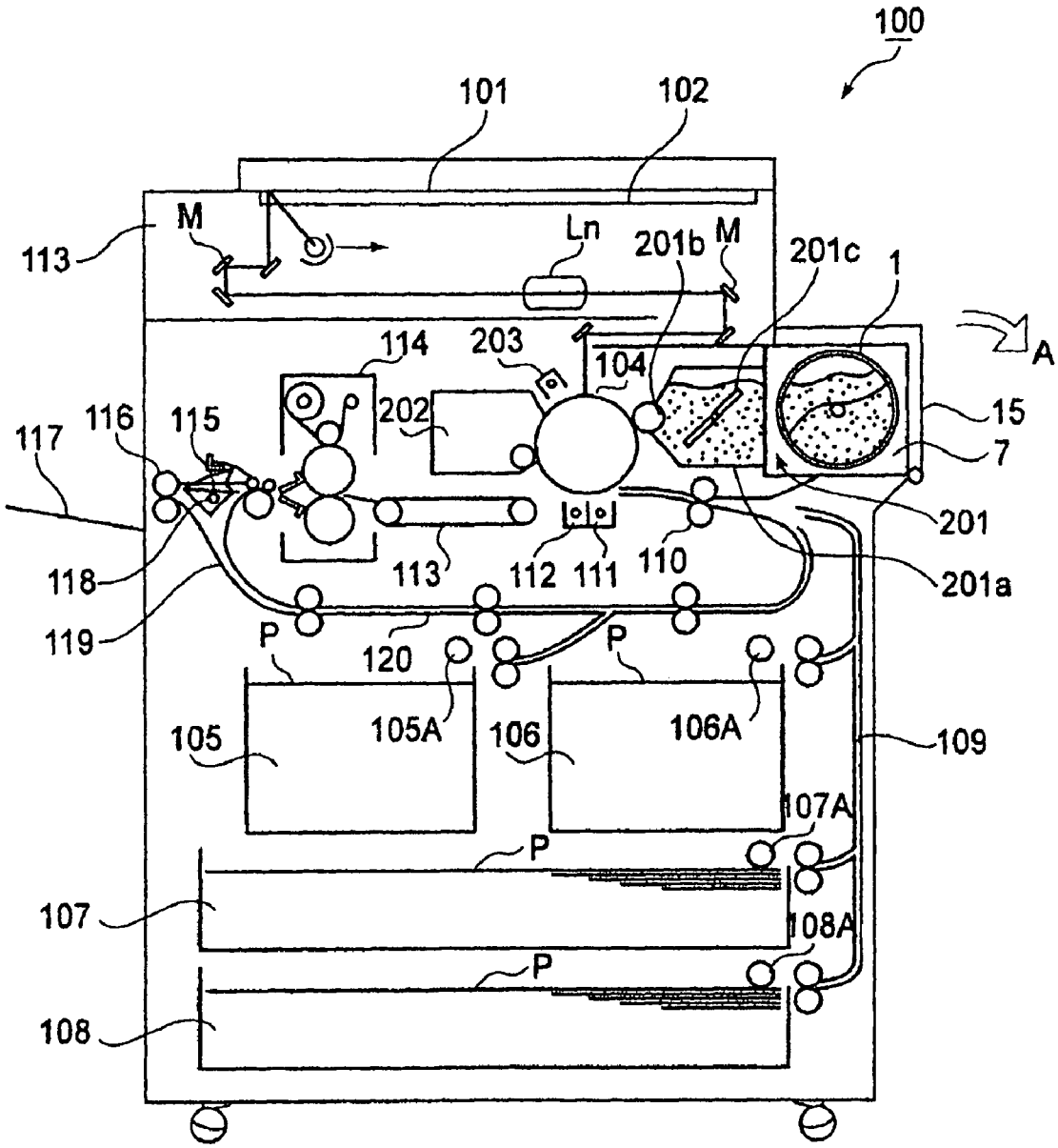
FIG. 1 is a sectional view illustrating a constitution of an electrophotographic copying machine as an example of an electrophotographic image forming apparatus in which a toner supply container is mounted.

In FIG. 1, designated by a reference numberal 100 is the main assembly of the electrophotographic copying machine (which hereinafter will be referred to as "apparatus main assembly"). Designated by reference numberal 101 is an original, which is placed on a glass platen 102. An optical image in accordance with the image formation data is formed on the electrophotographic photosensitive drum 104 by the combination of a plurality of mirrors M and a plurality of lenses Ln. Designated by reference numberals 105-108 are cassettes, from among which the cassette containing recording media (which hereinafter may be referred to simply as "papers (or sheets)") P, which agree in size with the information inputted by an operator through the control panel, or are the most suitable to the size of the original 101, are selected, based on the information regarding the sizes of the papers in the cassettes 105-108. The recording medium does not need to be limited to paper. For example, an OHP sheet or the like may be used as necessary.

The papers P are conveyed one by one by separating and conveying apparatuses 105A-108A, to a pair of registration rollers 110 by way of a paper conveyance path 109. Then, each paper P is conveyed further by the pair of registration rollers 110 in synchronism with the rotation of the photosensitive drum 104 and the scanning timing of the optical portion 103. Designated by reference numerals 111 and 112 are a transfer discharger for transferring the toner image formed on the photosensitive drum 104, onto the paper P, and a separation discharger for separating the paper P from the photosensitive drum 104 after the transfer of the toner image onto the paper P, respectively.

Thereafter, the paper P is further conveyed by a paper conveying portion 113 to the fixation portion 114, in which the toner image on the paper P is fixed by heat and pressure. Then, when the copying machine is in the single-sided print mode, the paper P is moved through a discharging reversing portion 115, without being placed upside down, and is discharged into the delivery tray 117 by a pair of discharge rollers 116. When the machine is in the two-sided print mode, the flapper 118 of the discharging reversing portion 115 is controlled so that the paper P is conveyed to the pair of registration rollers 110 by way of re-feeding conveyance paths 119 and 120. Then, the paper P is made to move through the same paths as those through which the paper P is moved when the machine is in the single-sided print mode, and is discharged into the delivery tray 117.

When the machine is in the multilayer print mode, the paper P is sent through the discharging reversing portion 115 so that it is stopped after it is partially extended outward from the main assembly by the pair of discharge rollers 116. More specifically, it is stopped immediately after the trailing edge of the paper P is moved past the flapper 118, while the paper P is remaining pinched by the pair of discharge roller 116. Then, the flapper 118 is switched in position, and the pair of discharge rollers 116 are rotated in reverse so that the paper P is conveyed back into the main assembly. Thereafter, the paper P is conveyed to the registration rollers 110 through paper re-conveyance paths 119 and 120. Then, it is moved through the same paths as those through it is moved when the machine is in the single-side print mode, and discharged into the delivery tray 117.

In the main assembly 100 of the copying machine structured as described above, the development portion 201, the cleaning portion 202, the primary charging portion (primary charger 203), etc., are disposed in the adjacencies of the peripheral surface of the drum 5-104. The development portion 201 is the portion in which the electrostatic latent image formed on the peripheral surface of the drum 104 by the optical portion 103, based on the image formation data extracted from the original 101, is developed with the use of toner as a developer. The toner supply container 1 for supplying this development portion 201 with toner is to be removably mounted in the main assembly 100 of the copying machine by a user.

The development portion 201 comprises a toner receiving apparatus 7 in which the toner supply container 1 is removably mounted, and a developing device 201*a*. Further, the developing device 201*a* comprises a development roller 201*b* and a developer conveying member 201*c*. After being supplied from the toner supply container 1 into the toner receiving apparatus 7, the toner is sent by the conveying member 201*c* to the development roller 201*b*, by which the toner is supplied to the photosensitive drum 104.

The cleaning portion 202 is where the toner remaining on the peripheral surface of the photosensitive drum 104 is removed. The primary charger 203 is for charging the photosensitive drum 104.

Figure 2:
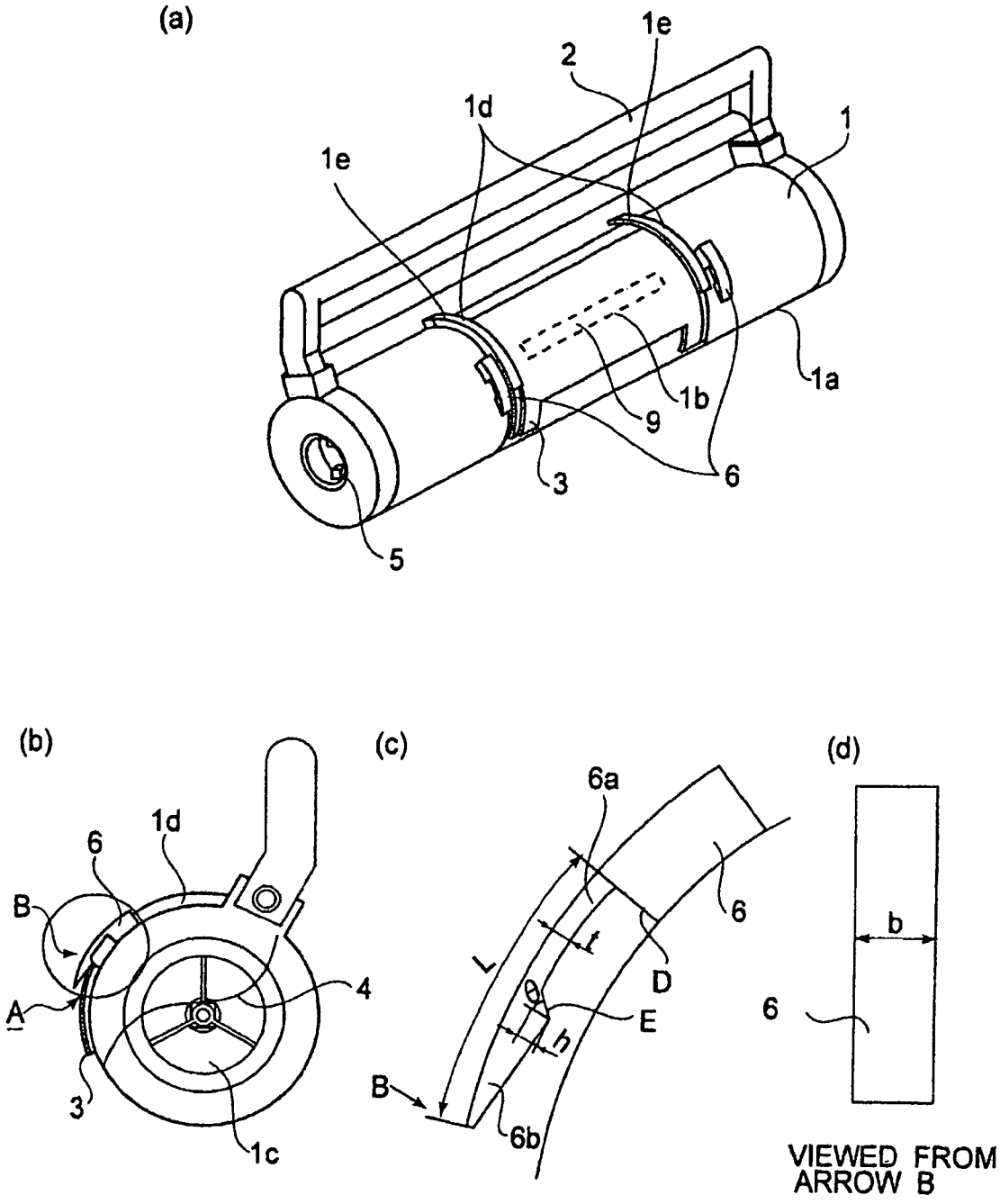
FIGS. 2(*a*) to 2(*d*) illustrate a toner supply container, wherein (a) is a perspective view thereof, (b) is a side view thereof, (c) is an enlarged view of a portion A, and (d) is a view viewed from an arrow B.

The main assembly 100 is provided with a cover for the replacement of a toner supply container, which constitutes a part of the external shell of the main assembly 100, and which is opened in the direction indicated by an arrow A in FIG. 2, when a user mounts the toner supply container 1 into the apparatus main assembly 100 or removes it therefrom.

(Toner Supply Container)

Next, referring to FIGS. 2(*a*)-2(*c*), the toner supply container 1 as a developer supply container in this embodiment will be described regarding its structure.

A container body 1*a* of the toner supply container 1, in which toner to be supplied to the toner receiving apparatus is stored, is a hollow cylindrical member. The cylindrical wall of the container body 1*a* is provided with a hole 1*b* as an toner outlet, which is roughly in the form of a rectangle, the longer edges of which are parallel to the lengthwise direction of the container body 1*a*. The container body 1*a* is also provided with a toner filling hole 1*c*, which is a part of one of the lengthwise end walls of the container body 1*a*, and which is sealed with an unshown sealing member or the like after the filling of the container body 1*a* with toner. The toner supply container 1 is also provided with a handle 2, which is to be grasped by a user when the user is mounting the toner supply container 1 into the apparatus main assembly 100 or removing it therefrom. The handle 2 is anchored to the lengthwise ends of the toner supply container 1. The configuration of the handle 2 does not need to be limited to the one in this embodiment. In other words, the handle 2 may be in any configuration as long as it can be used when a user is mounting or dismounting the toner supply container 1, and also, as long as it is satisfactory in terms of the function of rotating the toner supply container 1.

Referring to FIG. 2(*a*), the hole 1*b* is kept sealed by the shutter 3, the curvature of which matches that of the peripheral wall of the toner supply container 1. The shutter 3 is engaged with a pair of guiding members 1*d* located at the longitudinal ends of the container body 1*a*, being allowed to slide along the peripheral surface of the container body 1*a* in the circumferential direction of the container body 1*a*.

Figure 3:
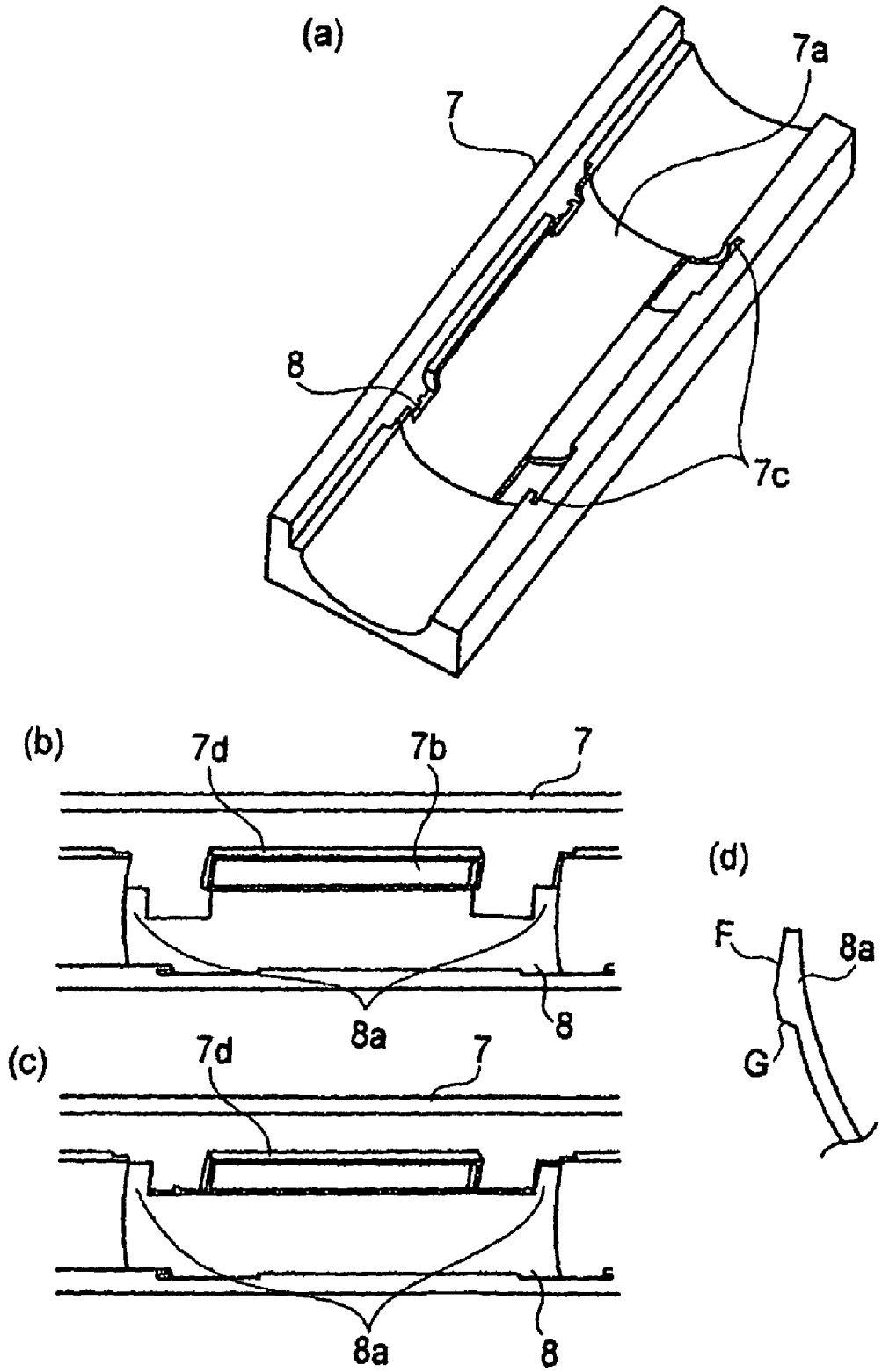
FIG. 3(*a*) is a perspective view showing a toner receiving apparatus, FIG. 3(*b*) is a perspective view showing the toner receiving apparatus in an open state of a supply opening of the toner receiving apparatus, FIG. 3(*c*) is a perspective view showing the toner receiving apparatus in a closed state of the supply opening of the toner receiving apparatus, and FIG. 3(*d*) is a sectional view showing an engaging portion of an apparatus shutter.

The toner supply container 1 and the container shutter 3 are structured so that when the toner supply container 1 is rotated after the insertion mounting of the toner supply container 1 into the toner receiving apparatus 7, rotation of the container shutter 3 is regulated by coming into contact with a stopper portion of the toner receiving apparatus 7 (FIGS. 3(*a*) to 3(*c*)) by rotation of the toner supply container 1.

In such a state that the rotation of the toner supply container 1 is regulated, when the toner supply container 1 is further rotated, the opening portion 1*b* is exposed from the container shutter 3 to be opened.

On the other hand, during replacement of the toner supply container 1, when the toner supply container 1 is rotated in the direction opposite to the direction in which the toner supply container 1 is rotated in order to open the opening portion 1*b*, the shutter 3 comes into contact with the other stopper portion of the toner receiving apparatus 7 so that the rotation of the container shutter 3 is regulated. As the toner supply container 1 is rotated further in such a state that the rotation of the container shutter 3 is regulated, the opening portion 1*b* is moved to the position where it is covered again with the container shutter 2 to be re-closed.

In the container body 1*a*, a stirring member 4 as a stirring and conveying member is provided. The stirring member 4 is constituted by a rotational axis portion provided concentric with a coupling 5 described later and a stirring blade portion which is attached to the rotational axis portion and is slidable with respect to an inner surface of the container body 1*a*. The stirring blade has a function of conveying the toner toward the opening portion 1*b* in addition to the function of stirring the toner contained in the container.

At the other longitudinal end surface of the container body 1*a*, the coupling 5, having a drive linkage relationship with the stirring member 4, is provided. In this embodiment, an integrally molded resinous portion of the rotational axis portion of the stirring member 4 and the coupling 5 is used.

After the toner supply container 1 is set in the main assembly of the image forming apparatus to be placed in a toner dischargeable state, the coupling 5, capable of coupling with a coupling mechanism of the apparatus main assembly, receives a rotational driving force. The stirring member 4 to which the rotational driving force is transmitted from the coupling 5 is moved relative to the toner supply container 1, which is in such a state that it is substantially non-rotationally fixed to the apparatus main assembly, so that the stirring member conveys and discharges the toner in the toner supply container 1 toward the opening portion 1*b* while stirring the toner. In this case, not the fixed state, the toner supply container 1 may also be configured so that the rotational movement thereof together with the stirring member 4 is at least regulated by the apparatus main assembly.

The container body 1*a* is provided with an engaging portions 6, as an interlocking portion (snap lock portion) for controlling the rotational movement between the container body 1*a* and the apparatus shutter 8. The engaging portions 6 are configured so that during a setting operation of the toner supply container 1 after it is inserted and mounted into the toner receiving apparatus 7, they are engageable with the apparatus shutter 8 described later.

As shown in FIG. 2(*c*), the engaging portion 6 is provided with a projection portion 6*a*, as an opening (unsealing) portion, for pushing down the apparatus shutter 8 by causing a surface D of the projection portion 6*a* to come into contact with the apparatus shutter 8, and with a claw portion, as a re-closing (resealing) portion, for pulling up the apparatus shutter 8 by causing a surface E of the claw portion 6*b* to engage with the apparatus shutter 8 during a re-opening operation of the supply opening 7*b*.

There is provided a certain gap between the above described claw portion 6*b* and the outer surface of the container body 1*a*. When a force is applied to the claw portion 6*b* from the direction indicated by an arrow B (FIG. 2(*b*)), the claw portion 6*b* elastically deforms toward the center of rotational movement of the container body 1*a*, and as the force is removed, it is restored to its original shape. More specifically, a resinous snap fit (snap lock)-type engaging portion (snap lock portion) is adopted. Incidentally, the elastic deformation direction of the claw portion 6*b* is not limited to a linear direction along the center line of rotational movement of the toner supply container 1, but may also be such a direction that the claw portion 6*b* is elastically deformed at a small intersection angle with respect to a straight line connecting the claw portion 6*b* with the rotational movement center of the toner supply container 1. Further, in order to enhance the reliability of re-closing by pulling up the apparatus shutter 8 to prevent yawing during the re-closing operation, the engaging portion 6 may preferably be provided at a position where it is engaged with each of portions in the neighborhood of both end portions of the apparatus shutter 8 in a longitudinal direction (rotational axis direction) of the apparatus shutter 8. Further, in view of the desire for balance during the pulling-up of the apparatus shutter 8, the plurality of engaging portions 6 preferably have the substantially same shape. In this embodiment, two engaging portions 6 having the substantially same shape are provided so as to be engaged with the portions close to the longitudinal end portions of the apparatus shutter 8.

Since the snap fit structural portions are provided as the engaging portions as described above, it is possible to not only reliably pull up the apparatus shutter 8 to re-close the apparatus shutter 8, but also to easily disengage the apparatus shutter 8 from the engaging portions 6 after the re-closing of the apparatus shutter 8. In other words, open/close movements of the apparatus shutter 8 utilizing the rotational movement of the developer supply container 1 can be performed by a simple constitution.

(Toner Receiving Apparatus)

Next, referring to FIGS. 3(*a*)-(*c*), the toner receiving apparatus 7 as a developer receiving apparatus of the main assembly of the image forming apparatus will be described regarding its structure.

The toner receiving apparatus 7 is provided with a mounting portion (mounting space) 7*a* in which the toner supply container 1 is removably mounted, and a supply opening 7*b* as a receiving opening through which the toner discharged from the toner supply container 1 is moved into the main assembly of the image forming apparatus.

The toner receiving apparatus 7 is also provided with the apparatus shutter 8 for freely opening and closing the supply opening 7*b*. The apparatus shutter 8 has such a shape that the curvature thereof matches that of the peripheral surface shapes of the toner supply container 1 and the mounting portion 7*a*, and is engaged with guiding members 7*c* located at the lower edges of the mounting portion 7*a*. With the provision of this structural arrangement, the apparatus shutter 8 is allowed to slide along the circumferential direction of the mounting portion 7*a* to open and close the supply opening 7*b*.

When the toner supply container 1 is not mounted in the mounting portion 7*a* of the toner receiving apparatus 7, the apparatus shutter 8 is in the position, shown in FIG. 3(*c*), in which the (upper) edge of the apparatus shutter 8 is in contact with the stopper 7*d* of the toner receiving apparatus 7, thus restricting further movement of the apparatus shutter 8. As described above, by closing the supply opening 7 by the apparatus shutter 8, the toner is prevented from moving back into the mounting portion 7*a* from the main assembly side of the image forming apparatus when the toner supply container 1 is not mounted.

Further, the apparatus shutter 8 is provided with engaging portions 8*a* for being engaged with the engaging portions 6 of the toner supply container 1 during a setting operation for rotationally moving the toner supply container 1 inserted and mounted into the toner receiving apparatus 7 from the mounting position to a toner supplying position, as shown in FIG. 3(*b*). In this embodiment, the engaging portions 8 are integrally resin-molded with the apparatus shutter 8, but may also be integrally bonded to each other with an adhesive after being prepared separately.

Figure 6:
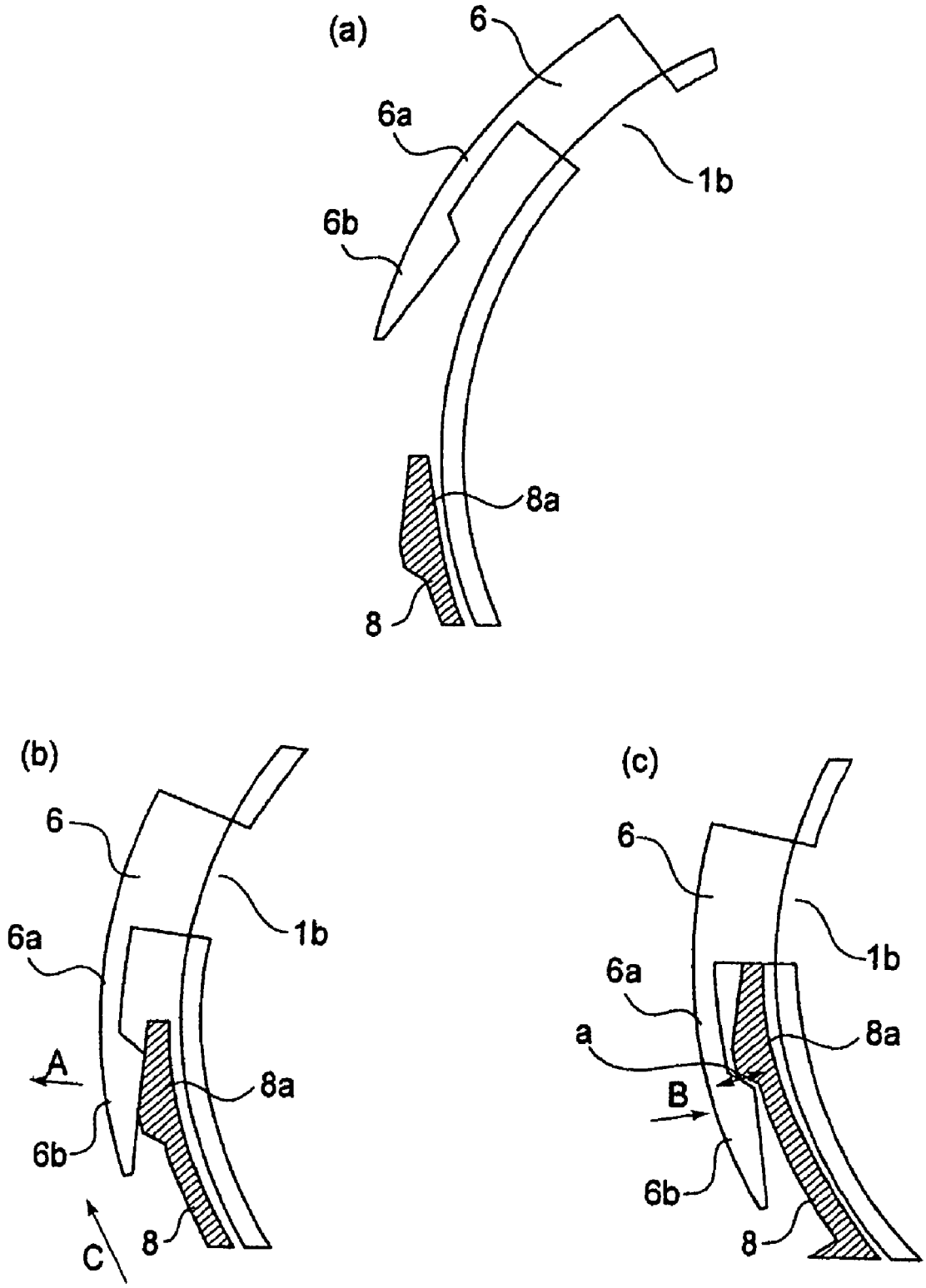
FIGS. 6(*a*) to 6(*c*) are cross-sectional side views of an engaging portion of the toner supply container and an engaging portion of the apparatus shutter, wherein (a) is a state immediately before engagement, (b) is a state during the engagement, and (c) is a state after the engagement.

The engaging portion 8*a* has a surface F (FIG. 3(*d*)) for elastically deforming the claw portion 6*b* toward a direction (the arrow A direction shown in FIG. 6(*a*)) opposite to the center of rotational movement of the toner supply container 1 by sliding along the claw portion 6*b* of the engaging portion 6 during the opening operation of the supply opening 7*b* (FIG. 6(*b*)). The elastic deformation of the elastically deformed claw portion 6*b* is released by further rotation of the toner supply container 1, so that the elastically deformed claw portion 6*b* is returned to the original position (the arrow B direction shown in FIG. 6(*c*)). Consequently, the engaging portion 6 and the engaging portion 8*a* are placed in a disengagement state.

The engaging portion 8*a* is further provided with a surface G (FIG. 3(*d*)) for raising the apparatus shutter 8 by abutment thereof against a surface E (FIG. 2(*c*)) of the engaging portion 6 during the re-closing operation of the supply opening 7*b*, as shown in FIG. 6(*c*)).

(Setting/Removal Operations of Toner Supply Container)

Next, setting and removal operations of the toner supply container 1 by using the toner supply container 1 and the toner receiving apparatus 7 in combination will be described with reference to FIGS. 4(*a*) and 4(*b*), FIGS. 5(*a*) to 5(*f*), and FIGS. 6(*a*) to 6(*c*) FIGS. 6(*a*) to 6(*c*) are enlarged views of the engaging portion 6 and its neighborhood in a state of FIG. 5(*a*), an intermediary state between states of FIGS. 5(*a*) and 5(*b*), and a state of FIG. 5(*b*), respectively.

The setting operation of the toner supply container 1 includes a step of inserting and mounting the toner supply container 1 into the toner receiving apparatus 7 and a step of rotationally moving the toner supply container 1 from the mounting position to a toner supplying position. On the other hand, the removal operation of the toner supply container 1 includes a step of rotationally moving the toner supply container 1 from the toner supplying position to the mounting position and a step of removing the toner supply container 1 in the mounting position from the toner receiving apparatus 7. Hereinbelow, these setting and removal operations will be explained more specifically.

First, a user grasps a handle 2 and effects insertion/mounting operations of the toner supply container 1. More specifically, the toner supply container 1 is mounted into the toner receiving apparatus 7 from the direction indicated by an arrow F. When the toner supply container 1 is inserted and mounted, it is positioned so that the opening portion 1*b* is directed upward and covered with the container shutter 3. In other words, the opening portion 1*b* is located apart from the supply opening 7*b* sealed with the apparatus shutter 8 (FIG. 6(*a*)). Similarly, the engaging portion 6 is also located apart from the engaging portion 8*a* (FIG. 6(*a*)).

The toner supply container 1 is structured so that in such a state that the bottom edge (leading edge in terms of direction in which the toner supply container 1 is moved to open the opening portion 1*b*) of the container shutter 3 roughly aligns (inclusive of tolerance in measurements of toner supply container 1 and toner receiving apparatus 7, and play) with the top edge of the supply opening 7*b*, the container shutter 3 is prevented by the stopper 7*d* from moving with the container body 1*a* in the circumferential direction of the container body 1*a*.

Figure 5:
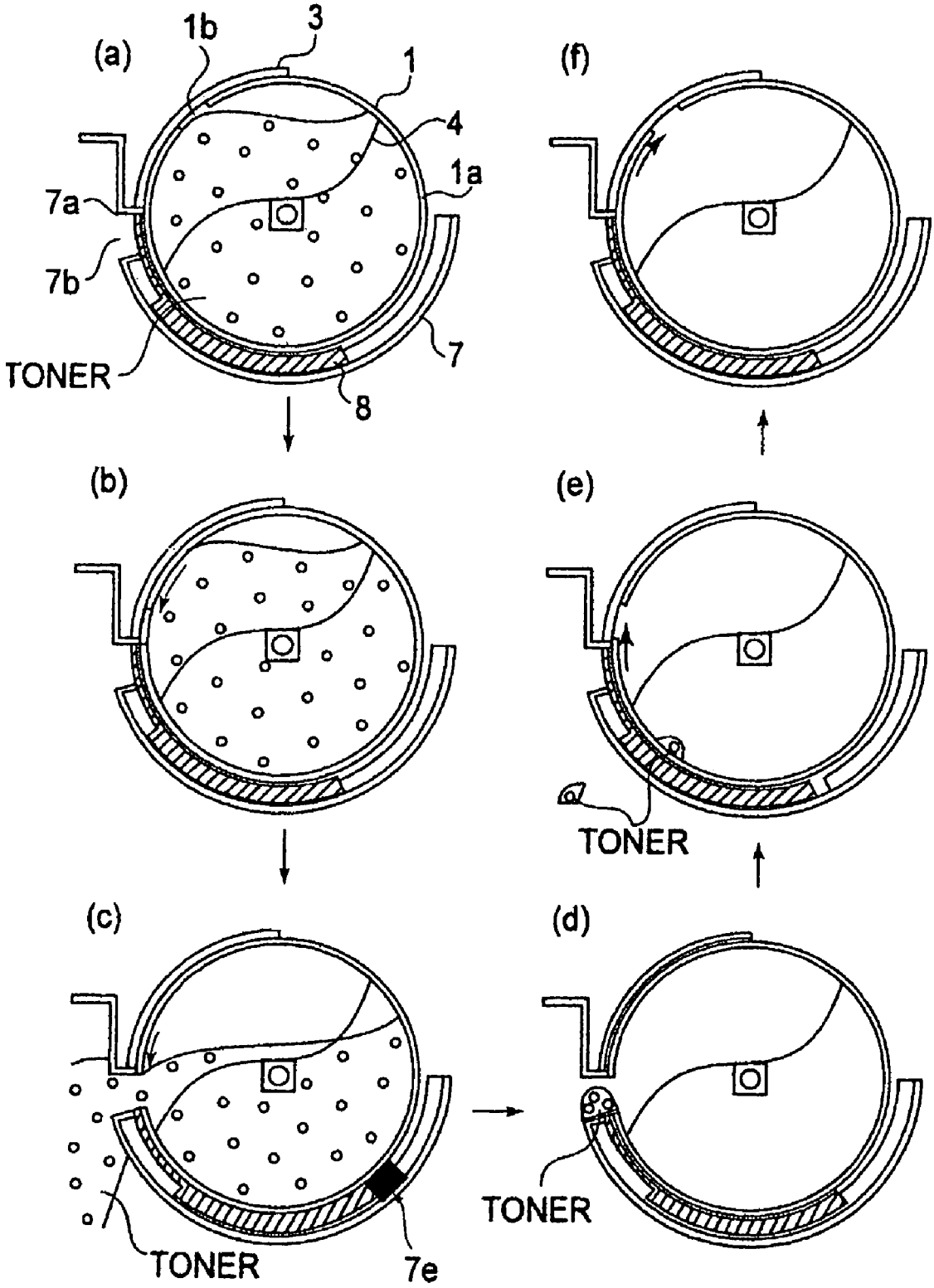
FIGS. 5(*a*) to 5(*f*) are cross-sectional side views of the toner supply container during a toner discharge operation, wherein (a) is a state immediately after mounting thereof, (b) is a state during rotation thereof, (c) is a state during toner discharge, (d) is a state after completion of the toner discharge, (e) is a state during rotation of the toner supply container, (f) is a state immediately before removal of the toner supply container.

Next, the user effects the rotational movement operation of the toner supply container 1 in the counterclockwise direction, as seen from the direction of the toner filling opening 1*c* (FIG. 5(*b*)), by grasping the handle 2. Initially, the container shutter 3 of the toner supply container 1 rotates with the container body 1*a* of the toner supply container 1. Then, it comes into contact with the aforementioned stopper 7*d* of the toner receiving apparatus 7, being prevented from rotating with the container body 1*a*.

Thus, as the toner supply container 1 is further rotated in the first direction, an inclined surface portion of the claw portion 6*b* of the engaging portion 6 runs on an inclined surface portion of the engaging portion 8*a* of the apparatus shutter 8 to be deformed elastically in a direction of the arrow A (FIG. 6(*b*)).

Then, with the rotational movement of the toner supply container 1, when the lower edge portion of the opening portion 1*b* is substantially in alignment with that of the container shutter 3, the claw portion 6*b* of the engaging portion 6 elastically deformed in the arrow A direction is elastically returned in the arrow B direction. As a result, the engaging portion 6 of the toner supply container 1 is engaged with the engaging portion 8*a* of the apparatus shutter 8 (FIG. 6(*c*)). At this time, the lower edge portion of the opening portion 1*b* is placed in such a state it is also in alignment with the upper edge portion of the apparatus shutter 8. In this case, the lower edge portion of the opening portion 1*b* refers to a portion, in the neighborhood of the leading edge of the opening portion 1*b* in the rotational movement direction of the opening portion 1*b*, i.e., an area within 2 mm from the leading edge of the opening portion 1*b*. The lower edge portion of the container shutter 3 refers to a portion in the neighborhood of the container shutter 3 in the rotational movement direction for opening the container shutter 3, i.e., an area within 2 mm from the leading edge of the container shutter 3. Further, the upper edge portion of the apparatus shutter 8 refers to a portion in the neighborhood of the trailing edge of the apparatus shutter 8 in the rotational movement direction of the apparatus shutter 8, i.e., an area within 2 mm from the trailing edge of the apparatus shutter 8.

In the above description, the case where the stopper 7*d* has a small thickness (a small length in the rotational movement direction of the container) is described. In the case where the stopper 7*d* has a thickness of not less than a predetermined value, the following constitution may preferably be employed. More specifically, the opening portion 1*b* and the engaging portion 6 may preferably be configured so that the lower edge portion of the opening portion 1*b* is protruded from the lower edge portion of the apparatus shutter 8 and at the substantially same time, the engaging portion 6 is engaged with the engaging portion 8*a* of the apparatus shutter 8. At this time, the lower edge portion of the opening portion 1*b* is substantially in phase with the upper edge portion of the apparatus shutter 8. Incidentally, also during the re-closing operation of the apparatus shutter 8 described later, timing setting may preferably be effected similarly in view of the thickness of the stopper 7*d*.

Figure 4:
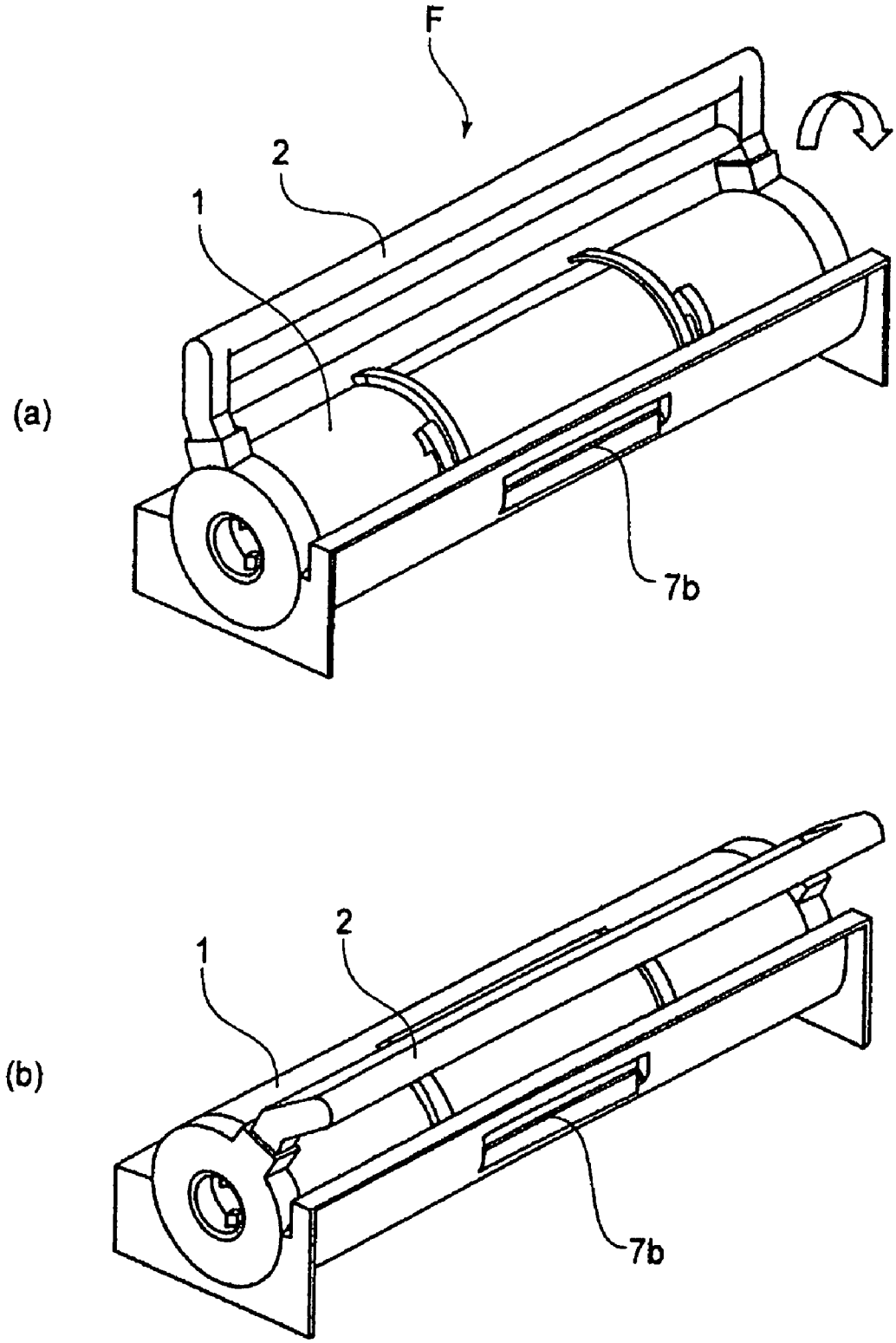
FIGS. 4(*a*) and 4(*b*) illustrate the toner supply container and the toner receiving apparatus, wherein (a) is a perspective view showing a state of the toner supply container immediately after being mounted in the toner receiving apparatus, and (b) is a perspective view showing a state of the toner supply container after the toner supply container is mounted in the toner receiving apparatus and a handle thereof is rotated.

Then, as the toner supply container 1 is further rotated in the same direction, the apparatus shutter 8 unseals the supply opening 7*b* (FIG. 4(*b*), FIG. 5(*c*)) by being pushed by the projection portion 6*a* of the engaging portion 6, while the upper edge portion remains substantially overlapped with the lower edge portion of the opening portion 1*b*.

Then, at the time when the supply opening 7*b* and the opening portion 1*b* finally communicate with each other, the apparatus shutter 8 comes into contact with the stopper 7*e* provided to the toner receiving apparatus 7 (FIG. 5(*c*)), so that the rotational movement of the apparatus shutter 8 is regulated. As a result, further rotational movement of the toner supply container 1 having an engagement relationship with the apparatus shutter 8 through the engaging portion 6 is also prevented by the stopper 7*e*. In other words, in this embodiment, the function of a stopper for stopping the rotational movement of the toner supply containers 1 is achieved by the engaging portion 6.

As described above, at a stage of the rotational movement of the toner supply container 1 by an operator until the supply opening 7*b* and the opening portion 1*b* are placed in a communication state, i.e., until further rotational movement is prevented, the setting operation of the toner supply container 1 is completed. Thereafter, the replacement cover 15 is closed by the operator.

With the closing operation of the replacement cover 15, the drive of the coupling mechanism of the main assembly of the image forming apparatus is started, so that rotation of the coupling 5, of the toner supply container 1, which is drive-linked with the coupling mechanism is started. As a result, a rotational force removed by the coupling 5 is transmitted to the stirring member 4 to perform toner supply from the toner supply container 1 to the toner receiving apparatus 7.

Next, the removal operation of the toner supply container 1 will be described.

When an amount of toner remaining in the toner supply container 1 is detected and judged by the image forming apparatus that it is insufficient, display to the effect that the toner supply container 1 should be replaced is effected at the operation portion of the image forming apparatus. In accordance with the display, the replacement cover 15 is opened by the operator.

At this time, there is a certain amount of toner, on the lower edge of the supply opening 7*b*, which has accumulated thereon during the toner discharge (FIG. 5(*d*)).

In this state, the user rotationally moves the toner supply container 1 in the clockwise direction (FIGS. 5(*a*)-5(*f*)) as the opposite rotational direction, as seen from the direction of the toner filling opening 1*c*, in terms of the axial direction of the toner supply container 1, by grasping the handle 2. The engaging portions 8*a* of the apparatus shutter 8 are pulled upward by the claw portion 6*b* because they remain engaged with the engaging portions 6 of the toner supply container 1. As a result, the apparatus shutter 8 is rotated with the toner supply container 1 similarly as in the case of the opening operation.

At this time, the upper edge portion of the apparatus shutter 8 and the lower edge portion of the opening portion 1*b* are substantially in alignment with each other in the rotational direction and, while retaining this state, pass through the communication portion of the supply opening 7*b* with the opening portion 1*b*. Further, the upper edge portion of the apparatus shutter 8 refers to a portion in the neighborhood of the leading edge of the apparatus shutter 8 in the rotational movement direction of the apparatus shutter 8 for re-closure (resealing), i.e., an area within 2 mm from the leading edge of the apparatus shutter 8. Further, the lower edge portion of the opening portion 1*b* refers to a portion, in the neighborhood of the trailing edge of the opening portion 1*b* in the rotational movement direction of the opening portion 1*b* for re-closure, i.e., an area within 2 mm from the trailing edge of the opening portion 1*b*.

During the above operation, the aforementioned certain amount of the toner having accumulated on the lower edge portion of the supply opening 7*b* is recovered into the toner receiving apparatus 7 through the supply opening 7*b*, and also into the container body 1*a* through the toner discharge hole 1*b*, as the toner supply container 1 is rotated to be resealed (FIG. 5(*e*)), drastically reducing the amount by which the toner supply container 1 is contaminated by the aforementioned accumulated toner.

With the employment of the above described constitution, it is possible to prevent the hand(s) of a user from being contaminated when the user removes the toner supply container 1 from the main assembly of the image forming apparatus. Therefore, it is possible to improve usability.

When the toner supply container 1 is further rotated to be resealed, the upper edge portion of the apparatus shutter 8 comes into contact with the lower surface of the stopper 7*d* of the toner receiving apparatus 7, preventing thereby the apparatus shutter 8 from rotating further with the toner supply container 1. Then, the engaging portions 6 link the rotational movements of the toner supply container 1 and the apparatus shutter 8 so that the upper edge portion of the opening portion 1*b* can start to enter the container shutter 3 substantially at the same time as the apparatus shutter 8 completely closes the supply opening 7*b*. In this case, the upper edge portion of the opening portion 1*b* refers to a portion, in the neighborhood of the leading edge of the opening portion 1*b* in the rotational movement direction of the opening portion 1*b* for resealing, i.e., an area within 2 mm from the leading edge of the opening portion 1*b*.

As the toner supply container 1 is rotated further, the claw portion 6*b* of each of the engaging portions 6 is elastically deformed in the direction (arrow A direction of FIG. 6(*b*)) to allow itself to be disengaged from the engaging portion 8*a* of the engaging portion 8, because the apparatus shutter 8 is prevented by the stopper 7*d* from rotating further. When the toner Supply container 1 is further rotated, the claw portion 6*b* of the engaging portion 6 is disengaged from the engaging portion 8*a* of the apparatus shutter 8 to be elastically returned in the arrow B direction of FIG. 6(*c*). Thereafter, when the toner supply container 1 is to be further rotated, the toner discharge hole 1*b* is placed in such a state that it is completely shut by the container shutter 3, which is being prevented by the toner receiving apparatus 7 from rotationally moving in the rotational direction. At this time, the stopper projection 1*e* (FIG. 2) provided to the guide member 1*d* comes into contact with the container shutter 3, thus preventing the toner supply container 1 from being rotated further to restore the toner supply container 1 to the state shown in FIG. 5(*a*).

Lastly, the user pulls the toner supply container 1 out of the toner receiving apparatus 7 to complete the sequence of operations for resealing and removing the toner supply container 1.

In this embodiment, the direction from which the toner supply container 1 is mounted into the toner receiving apparatus 7 is from above (direction indicated by arrow F in FIG. 4(*a*). However, it does not need to be limited to this direction. For example, the toner supply container 1 and toner receiving apparatus 7 may be structured as disclosed in Japanese Laid-open Patent Applications Hei 07-199623 or Hei 07-44000, so that the toner supply container 1 is mounted from the front side of the main assembly, more specifically, the toner supply container 1 is horizontally mounted into, or removed from, the toner receiving apparatus 7, in the direction parallel to the longitudinal direction of the toner supply container 1.

Also in this embodiment, the toner supply container 1, and the main assembly of the image forming apparatus, are configured so that the opening portion 1*b* communicates with the supply opening 7*b* provided at a side of the mounting portion of the toner receiving apparatus 7 when the opening portion 1*b* is directed in the substantially horizontal direction. However, they do not need to be configured in this manner.

Further, the rotational movement direction of the toner supply container 1 during the setting operation does not need to be limited to the direction in the above described embodiment. For example, the toner supply container 1 and the main assembly of the image forming apparatus may be configured so that the toner supply container 1 is mounted, with the opening portion 1*b* facing downward, and so that in order to unseal the toner supply container 1, the toner supply container 1 is rotated in the direction opposite to the direction in the above described embodiment, and in order to reseal the toner supply container 1, the toner supply container 1 is rotated in the direction opposite to the direction in the above described embodiment.

The above described state of the toner supply container 1 and toner receiving apparatus 7, in which the lower edge portion of the opening portion 1*b* and the upper edge portion of the apparatus shutter 8 are substantially in alignment with each other in the rotational direction, means that a deviation (L) between the lower edge of the opening portion 1*b* and the upper edge of the apparatus shutter 8, in terms of the rotational direction of the toner supply container 1 is within ±5 mm in the rotational direction. According to the levels of the contamination by toner, confirmed after the completion of the operation for supplying the main assembly of the image forming apparatus with toner, as long as the deviation (L) is within ±5 mm, the level of the contamination by toner is not problematic, that is, no worse than that when the deviation (L) was zero (state shown in FIGS. 5(*a*)-5(*f*)).

As described above, according to this embodiment, during the operation for setting the toner supply container in the toner receiving apparatus, it is possible to reliably and easily open and close the apparatus shutter and the container shutter and to minimize the contamination of the toner supply container 1 by toner.

(Constitution of Engaging Portion 6)

As described above, the claw portion 6*b* of the engaging portion 6 is required to have a function of completing resealing (re-closure) of the apparatus shutter 8 by raising the apparatus shutter 8 while retaining the engagement with the engaging portion 8*a* of the apparatus shutter 8 during the removal operation of the toner supply container 1. In other words, it is preferable that the engaging portion 6 and the engaging portion 8*a* have a strong engagement relationship (snap lock force) therebetween.

On the other hand, the claw portion 6*b* of the engaging portion 6 is also required to have a function of completing disengagement thereof with the engaging portion 8*a* after the apparatus shutter 8 is resealed. In other words, it is preferable that the engagement relationship (snap lock force) between the engaging portion 6 and the engaging portion 8*a* is weak.

Accordingly, the engaging portion 6 is required to satisfy these contradictory two functions.

The engaging portion 6 is also required to reliably engage with the engaging portion 8*a* during the setting operation of the toner supply container 1.

In view of these functions, as a result of experiments/verifications (FIGS. 1-6 and Comparative Examples 1-4) described later, it has been confirmed that a release force (disengaging force) F(N) and an elastic deformation force P(N) may preferably satisfy the following relationship (Table 1 and FIG. 7):

$$P(N)=kF(N)\ (0.25\leqq k\leqq 1),$$

wherein P(N) represents a release force (disengaging force) required for releasing engagement of the engaging portion 6 with the engaging portion 8*a*, i.e., a force in the rotational direction required for disengaging these engaging portions 7 and 8*a* while rotationally moving the toner supply container 1 in the direction (the arrow C direction of FIG. 6(*c*)) during the removal operation of the toner supply container 1, and F(N) represents an elastic deformation force of the engaging portion 6 in the arrow A direction of FIG. 6(*b*), i.e., in a radial direction extending from the center of (rotational movement of) the toner supply container 1 toward the claw portion 6*b*. The elastic deformation force is an index of such an elastic deformation characteristic that the engaging portion 6 is less liable to be deformed with a larger value and is more liable to be deformed with a smaller value.

When the above relationship is satisfied, it is possible to not only reseal (re-close) the apparatus shutter 8 by reliably raising the apparatus shutter 8 but also reliably disengaging the apparatus shutter 8 and the toner supply container 1 from each other.

Incidentally, when the release force F is excessively large, not only are the engaging portion 6 and the engaging portion 8*a* less liable to be disengaged but also an operation force is required for rotationally moving the toner supply container 1 during the removal operation of the toner supply container 1. On the other hand, when the release force F is excessively small, there is a possibility that the engagement between the apparatus shutter and the engaging portion is removed or released before completion of the resealing of the apparatus shutter. As a result of further verification from such a viewpoint, the release force F(N) may preferably be set to satisfy: $5\leqq F(N)\leqq 30$.

When the elastic deformation force P is excessively large, the engaging portion 6 itself becomes rigid, so that breakage thereof is liable to occur during deformation in the engaging operation. On the other hand, when the elastic deformation force P is excessively small, the engaging portion 6 itself becomes soft, so that there is a possibility that deformation during engagement is not restored, so that engagement failure is caused to occur. As a result of further verification from such a viewpoint, the elastic deformation force P(N) may preferably be set to satisfy: $3\leqq P(N)\leqq 15$.

The above described elastic deformation force P(N) can be measured in the following manner.

As shown in FIG. 2(*c*) or FIG. 6(*c*), in the arrow B direction, i.e., in the radial direction directed toward the center of (rotational movement) of the toner supply container, the leading edge portion (an area within 3 mm from the leading edge of) the claw portion 6*b* is pressed in to a depth corresponding to an amount of deformation h (mm) during the engagement of the claw portion 6*b* with the apparatus shutter 8. In this embodiment, the deformation amount is set so that the center of a pressing portion of a compression-stretching tester described later abuts against the area within 3 mm from the leading edge of the claw portion 6*b*. In such a condition, a maximum load (N) at the time of elastically deforming the engaging portion 6 is measured. Accordingly, the elastic deformation force P(N) is also referred to as an elastic repulsive force (N) or an elastic restoring force (N).

Incidentally, an actual deformation direction of the claw portion 6*b* is the arrow A direction (FIG. 6(*b*)) opposite to the arrow B direction (FIG. 6(*c*)). In this embodiment, however, for simplicity of measurement, the arrow B direction, i.e., the pressing direction is taken as the deformation direction. Other measurement conditions of the elastic deformation force are shown below. In this embodiment, the deformation amount h (mm) is the same value as an engagement depth a (mm) described later. In the case where these values are not equal to each other, the elastic deformation force may be measured after the deformation amount is measured.

(Measurement Conditions)

Measuring machine: A compression-stretching tester ("Model: RTC-1225A", mfd. by ORIENTEC Co., Ltd.)

Down speed: 10 (mm/sec)

Further, the above described release force F(N) may be measured in the following manner.

A maximum load (N) in the arrow C direction (the rotational movement direction of the toner supply container) at the time of disengaging the claw portion 6*b* of the engaging portion 6 with the engaging portion 8*a* of the apparatus shutter 8 is measured (as shown in the operational states of FIG. 6(*c*), FIG. 6(*b*), and FIG. 6(*a*) in this order).

(Measurement Conditions)

Measuring machine: A torque gauge ("Model: 15BTG", mfd. by TOHNICHI MFG. Co., Ltd.)

Measuring speed: 100 (mm/sec)

More specifically, for measurement of the release force F, the torque gauge is fixed at a longitudinal end surface of the toner supply container and the toner supply container is rotationally moved in such a direction that engagement between the claw portion 6*b* of the engaging portion 6 and the engaging portion 8*a* of the apparatus shutter 8 is released. Then, a maximum load (N) during disengagement of the claw portion 6*b* and the engaging portion 8*a* is measured and divided by the number of the engaging portions 6 (two in this embodiment) to obtain a release force per one engaging portion 6. Similarly, in the case where the number of engaging portions 6 is increased, the release force can be appropriately determined depending on the number of engaging portions 6.

In this embodiment, the above described elastic deformation force P and release force F are obtained through a single measurement but may also be determined as an average of a plurality of the above described measurements as desired.

In order to obtain the proper elastic deformation force of the claw portion 6*b* of the engaging portion, the bending modulus (of elasticity) and shape dimensions of the claw portion 6*b* are appropriately set.

The bending modulus is a factor determined by a resinous material constituting the claw portion 6*b*, so that the resinous material used is appropriately selected. Further, the shape dimensions includes factors such as a width b of the claw portion 6*b* (a length in the longitudinal direction of the toner supply container 1), a length L of the claw portion 6*b* (a circumferential length in the circumferential direction of the toner supply container 1, and a thickness t of the claw portion 6*b* and are appropriately set.

By optimizing these factors depending on designing conditions of the toner supply container 1, such as a space, cost, molding condition, etc., it is possible to appropriately set the elastic deformation force of the engaging portion 6.

In order to obtain the above described release force of the claw portion 6*b* of the engaging portion 6, in this embodiment, an engagement angle θ (FIG. 2(*c*)) between the claw portion 6*b* of the engaging portion 6 and the engaging portion 8*a* of the apparatus shutter 8 and an amount a of engagement (FIG. 6(*c*)) between the claw portion 6*b* and the engaging portion 8*a* are appropriately set. The engagement angle θ is an angle from, as a reference line (zero degrees), a straight line connecting a maximum protruded portion of the claw portion 6*b* in a radial direction with a center of rotational movement of the toner supply container 1. Further, the engagement amount a is a depth or length at a portion where the claw portion 6*b* and a claw portion of the engaging portion 8*a* are most intimately engaged with each other.

By optimizing these factors depending on the design conditions of the toner supply container 1, such as a space, cost, molding condition, etc., it is possible to appropriately set the release force of the engaging portion 6.

<Experiments/Verifications>

Figure 7:
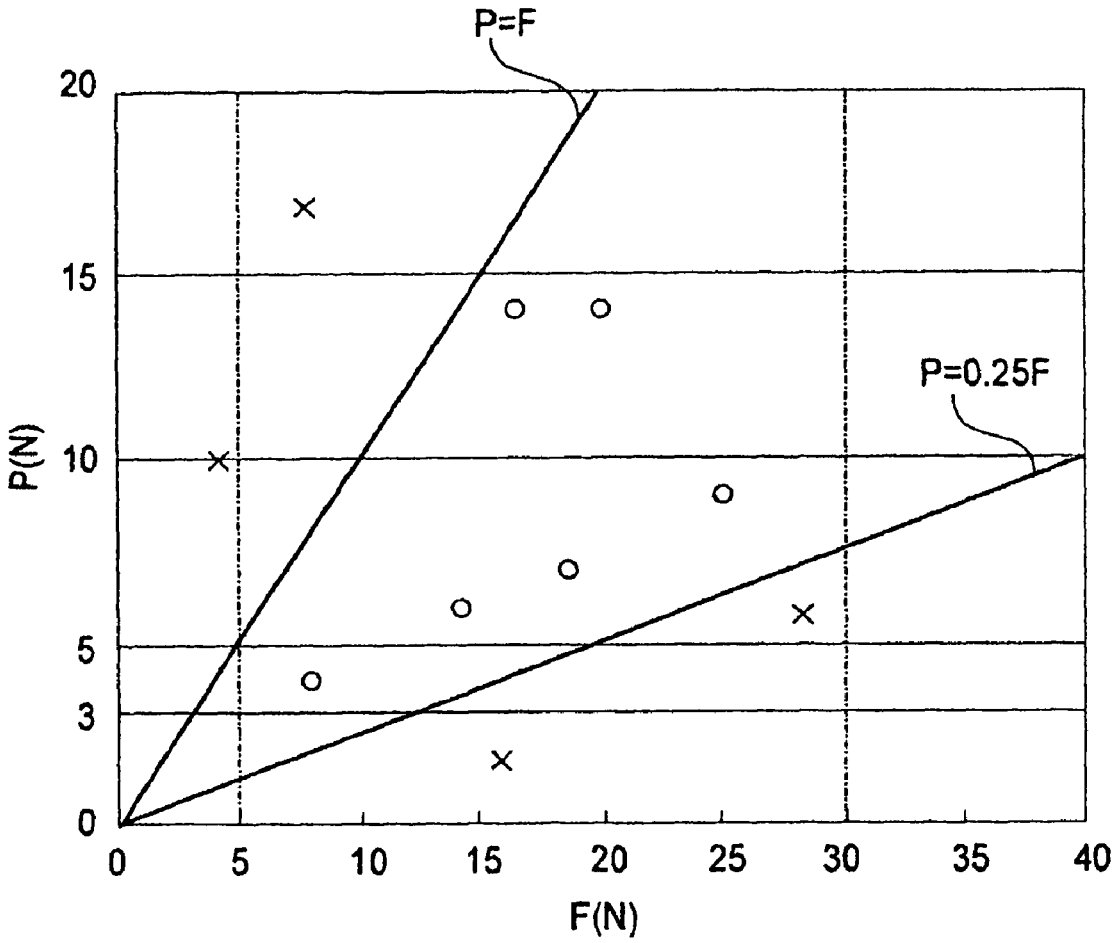
FIG. 7 is a graph showing a relationship between an elastic deformation force and a release force of an engaging portion 6.

Results of experiments/verifications of the elastic deformation force and the release force of the engaging portion 6 will be described, with reference to Table 1 shown below and FIG. 7, based on Embodiments 1 to 6 and Comparative Examples 1 to 4.

In these Embodiments and Comparative Embodiments (which are specifically described later), engaging portions 6 are prepared in the indicated conditions and are evaluated with respect to the following items (1) to (3):

(1) a rotational (movement) torque, of the toner supply container 1 during engagement between the claw portion 6*b* of the engaging portion 6 and the engaging portion 8*a* of the apparatus shutter 8, measured by rotating the toner supply container 1 after the toner supply container 1 is mounted into the main assembly of the image forming apparatus, (2) a rate (%) of occurrence of disengagement of the claw portion 6*b* of the engaging portion 6 and the engaging portion 8*a* of the apparatus shutter 8 in a period from rotation of the toner supply container 1 after completion of the toner supply operation until the supply opening is closed or sealed by the apparatus shutter 8, and (3) a rotational (movement) torque, of the toner supply container 1 during engagement between the claw portion 6*b* of the engaging portion 6 and the engaging portion 8*a* of the apparatus shutter 8, measured by rotating the toner supply container 1 after the supply opening is closed by the apparatus shutter 8.

The results of experiments and verifications are summarized in Table 1 below. With reference to Table 1, Embodiments 1 to 6 and Comparative Embodiments 1 to 4 will be specifically described hereinafter in this order. In the following Embodiments, the rotational torque may preferably be set to a value of not more than 137.7 N.cm (14.0 kgf.cm) in view of an operation force of the user.

TABLE 1

| EMB. No. | Bending Modulus (MPa) | Dimensions (mm) Width: b | Length: L | Thickness: t | Elastic Deformation Force: P(N) | Angle: θ (deg.) | Depth of Engagement: a (mm) | Release Force: F(N) | Torque (N · cm) Engagement (1) | Disengagement (3) | Rate of Disengagement (2) | Evaluation |
|---|---|---|---|---|---|---|---|---|---|---|---|---|
| EMB.1 | 1400 | 5.5 | 16.5 | 1 | 4 | 50 | 1 | 8 | 33.3 | 39.2 | 0% | ○ |
| EMB.2 | 2160 | 5.5 | 16.5 | 1 | 6 | 40 | 1.5 | 14 | 50.0 | 49.0 | 0% | ○ |
| EMB.3 | 2400 | 5.5 | 16.5 | 1 | 7 | 40 | 1.5 | 18 | 58.8 | 78.5 | 0% | ○ |
| EMB.4 | 2400 | 6.5 | 16.5 | 2 | 14 | 40 | 2 | 16 | 117.7 | 98.1 | 0% | ○ |
| EMB.5 | 2400 | 6.5 | 16.5 | 2 | 14 | 30 | 2 | 20 | 117.7 | 137.3 | 0% | ○ |
| EMB.6 | 4020 | 6.5 | 16.5 | 1 | 9 | 25 | 2 | 26 | 75.5 | 117.7 | 0% | ○ |
| COMP.EMB.1 | 4020 | 6 | 16.5 | 1 | 10 | 80 | 1 | 4 | 84.3 | 19.6 | 80% | X |
| COMP.EMB.2 | 4020 | 6.5 | 16.5 | 3 | 17 | 70 | 1 | 8 | 143.2 | 29.4 | 50% | X |
| COMP.EMB.3 | 1400 | 4 | 16.5 | 1 | 2 | 20 | 2 | 16 | 33.3 | 147.1 | 0% | X |
| COMP.EMB.4 | 2400 | 5.5 | 16.5 | 1 | 6 | 10 | 2 | 28 | 50.0 | 186.3 | 0% | X |

Embodiment 1

In Embodiment 1, as a material for an engaging portion 6 (of a container body 1*a*), a low-density polyethylene (LD-PE) resin ("Suntec-RD J310", mfd. by Asahi Kasei Chemicals Corp.; flexural modulus: 1400 MPa) was used.

The engaging portion 6 had dimensions including a width b of 5.5 mm, a length L of a claw portion 6*b* of 16.5 mm, a thickness t of the claw portion 6*b* of 1 mm, and an angle θ of the claw portion 6*b* of 50 degrees. A depth a of engagement between the engaging portion 6 and the apparatus shutter 8 was 1.0 mm.

In order to measure the elastic deformation force P of the claw portion 6*b* of the engaging portion 6, the toner supply container 1 was set in a compression-stretching testing machine. As a result of measurement, the elastic deformation force P was 4.0N (0.4 kgf).

Further, in order to measure the release force F of the claw portion 6*b* of the engaging portion 6, the toner supply container 1 was set in the toner receiving apparatus 7. As a result of measurement, the release force F was 8.0 N (0.8 kgf).

From the above described relationship: P=kF, k is 0.5, thus being in the range of $0.25 \leqq k \leqq 1$.

Then, the toner supply container 1 was mounted in a main assembly of an image forming apparatus in a state in which 400 g of a magnetic toner was filled in the toner supply container 1. Thereafter, the toner supply container 1 was rotated to measure the rotational torque at the time of engagement between the engaging portion 6 and the engaging portion 8 and at the time of disengagement therebetween. As a result, the rotational torque at the time of engagement was 33.3 N.cm (3.4 kgf.cm) and the rotational torque at the time of disengagement was 39.2 N.cm (4.0 kgf.cm), thus being not more than 137.3 N.cm (14.0 kgf.cm).

After completion of toner supply, an operation check was performed 100 times in order to calculate the probability of disengagement between the engaging portion 6 and the apparatus shutter 8 in a period from the rotation of the toner supply container 1 until the supply opening is re-closed by the apparatus shutter 8. As a result, in all the operations, a good interlocking state was ensured, i.e., disengagement was not caused to occur. Accordingly, the probability of occurrence of disengagement was 0%.

Embodiment 2

In Embodiment 2, as a material for an engaging portion 6 (of a container body 1*a*), a high-impact polystyrene (HI-PS) resin ("AGI02", mfd. by DS Japan; flexural modulus: 2160 MPa) was used.

The engaging portion 6 had dimensions including a width b of 5.5 mm, a length L of a claw portion 6*b* of 16.5 mm, a thickness t of the claw portion 6*b* of 1 mm, and an angle θ of the claw portion 6*b* of 40 degrees. A depth a of engagement between the engaging portion 6 and an apparatus shutter 8 was 1.5 mm.

In the same manner as in Embodiment 1, as a result of measurement of the elastic deformation force and the release force F of the claw portion 6*b* of the engaging portion 6, the elastic deformation force P was 6.0 N (0.6 kgf) and the release force F was 14.0 N (1.4 kgf).

From the above described relationship: P=kF, k is 0.43, thus being in the range of $0.25 \leqq k \leqq 1$.

Then, in the same manner as in Embodiment 1, as a result of measurement of the rotational torque at the time of engagement between the engaging portion 6 and the engaging portion 8 and at the time of disengagement therebetween, the rotational torque at the time of engagement was 50.0 N.cm (5.1 kgf.cm) and the rotational torque at the time of disengagement was 49.0 N.cm (5.0 kgf.cm), thus being not more than 137.3 N.cm (14.0 kgf.cm).

After completion of toner supply, an operation check was performed 100 times in order to calculate the probability of disengagement between the engaging portion 6 and the apparatus shutter 8 in a period from the rotation of the toner supply container 1 until the supply opening is closed by the apparatus shutter 8. As a result, in all the operations, a good interlocking state was ensured, i.e., disengagement was hot caused to occur. Accordingly, the probability of occurrence of disengagement was 0%.

Embodiment 3

In Embodiment 3, as a material for an engaging portion 6 (of a container body 1*a*), a high-impact polystyrene (HI-PS) resin ("NS130", mfd. by DS Japan; flexural modulus: 2400 MPa) was used.

The engaging portion 6 had dimensions including a width b of 5.5 mm, a length L of a claw portion 6*b* of 16.5 mm, a thickness t of the claw portion 6*b* of 1 mm, and an angle θ of the claw portion 6*b* of 40 degrees. A depth a of engagement between the engaging portion 6 and an apparatus shutter 8 was 1.5 mm.

In the same manner as in Embodiment 1, as a result of measurement of the elastic deformation force and the release force F of the claw portion 6*b* of the engaging portion 6, the elastic deformation force P was 7.0 N (0.7 kgf) and the release force F was 18.0 N (1.8 kgf).

From the above described relationship: P=kF, k is 0.39, thus being in the range of 0.25≦k≦1.

Then, in the same manner as in Embodiment 1, as a result of measurement of the rotational torque at the time of engagement between the engaging portion 6 and the engaging portion 8 and at the time of disengagement therebetween, the rotational torque at the time of engagement was 58.8 N.cm (6.0 kgf.cm) and the rotational torque at the time of disengagement was 78.5 N.cm (8.0 kgf.cm), thus being not more than 137.3 N.cm (14.0 kgf.cm).

After completion of toner supply, an operation check was performed 100 times in order to calculate the probability of disengagement between the engaging portion 6 and the apparatus shutter 8 in a period from the rotation of the toner supply container 1 until the supply opening is closed by the apparatus shutter 8. As a result, in all the operations, a good interlocking state was ensured, i.e., disengagement was not caused to occur. Accordingly, the probability of occurrence of disengagement was 0%.

Embodiment 4

In Embodiment 4, as a material for an engaging portion 6 (of a container body 1*a*), a high-impact polystyrene (HI-PS) resin ("NS130", mfd. by DS Japan; flexural modulus: 2400 MPa) was used.

The engaging portion 6 had dimensions including a width b of 6.5 mm, a length L of a claw portion 6*b* of 16.5 mm, a thickness t of the claw portion 6*b* of 2 mm, and an angle θ of the claw portion 6*b* of 40 degrees. A depth a of engagement between the engaging portion 6 and an apparatus shutter 8 was 2 mm.

In the same manner as in Embodiment 1, as a result of measurement of the elastic deformation force and the release force F of the claw portion 6*b* of the engaging portion 6, the elastic deformation force P was 14.0 N (1.4 kgf) and the release force F was 16.0 N (1.6 kgf).

From the above described relationship: P=kF, k is 0.88, thus being in the range of 0.25≦k≦1.

Then, in the same manner as in Embodiment 1, as a result of measurement of the rotational torque at the time of engagement between the engaging portion 6 and the engaging portion 8 and at the time of disengagement therebetween, the rotational torque at the time of engagement was 117.7 N.cm (12.0 kgf.cm) and the rotational torque at the time of disengagement was 98.1 N.cm (10.0 kgf.cm), thus being not more than 137.3 N.cm (14.0 kgf.cm).

Similarly as in Embodiment 1, an operation check was performed 100 times in order to calculate the probability of disengagement between the engaging portion 6 and the apparatus shutter 8. As a result, in all the operations, a good interlocking state was ensured, i.e., disengagement was not caused to occur. Accordingly, the probability of occurrence of disengagement was 0%.

Embodiment 5

In Embodiment 5, as a material for an engaging portion 6 (of a container body 1*a*), a high-impact polystyrene (HI-PS) resin ("NS130", mfd. by DS Japan; flexural modulus: 2400 MPa) was used.

The engaging portion 6 had dimensions including a width b of 6.5 mm, a length L of a claw portion 6*b* of 16.5 mm, a thickness t of the claw portion 6*b* of 2 mm, and an angle θ of the claw portion 6*b* of 30 degrees. A depth a of engagement between the engaging portion 6 and an apparatus shutter 8 was 2 mm.

In the same manner as in Embodiment 1, as a result of measurement of the elastic deformation force and the release force F of the claw portion 6*b* of the engaging portion 6, the elastic deformation force P was 14.0 N (1.4 kgf) and the release force F was 20.0 N (2.0 kgf).

From the above described relationship: P=kF, k is 0.7, thus being in the range of 0.25≦k≦1.

Then, in the same manner as in Embodiment 1, as a result of measurement of the rotational torque at the time of engagement between the engaging portion 6 and the engaging portion 8 and at the time of disengagement therebetween, the rotational torque at the time of engagement was 117.7 N.cm (12.0 kgf.cm) and the rotational torque at the time of disengagement was 137.3 N.cm (14.0 kgf.cm), thus being not more than 137.3 N.cm (14.0 kgf.cm).

Similarly as in Embodiment 1, an operation checkwas performed 100 times in order to calculate the probability of disengagement between the engaging portion 6 and the apparatus shutter 8. As a result, in all the operations, a good interlocking state was ensured, i.e., disengagement was not caused to occur. Accordingly, the probability of occurrence of disengagement was 0%.

Embodiment 6

In Embodiment 6, as a material for an engaging portion 6 (of a container body 1*a*), a high-impact polystyrene (HI-PS) resin ("F5451G10", mfd. by Techno Polymer Co., Ltd.; flexural modulus: 4020 MPa) was used.

The engaging portion 6 had dimensions including a width b of 6.5 mm, a length L of a claw portion 6*b* of 16.5 mm, a thickness t of the claw portion 6*b* of 1 mm, and an angle θ of the claw portion 6*b* of 25 degrees. A depth a of engagement between the engaging portion 6 and the apparatus shutter 8 was 2 mm.

In the same manner as in Embodiment 1, as a result of measurement of the elastic deformation force and the release force F of the claw portion 6*b* of the engaging portion 6, the elastic deformation force P was 9.0 N (0.9 kgf) and the release force F was 25.0 N (2.5 kgf).

From the above described relationship: P=kF, k is 0.36, thus being in the range of 0.25≦k≦1.

Then, in the same manner as in Embodiment 1, as a result of measurement of a rotational torque at the time of engagement between the engaging portion 6 and an engaging portion 8 and at the time of disengagement therebetween, the rotational torque at the time of engagement was 75.5 N.cm (7.7 kgf.cm) and the rotational torque at the time of disengagement was 117.7 N.cm (12.0 kgf.cm), thus being not more than 137.3 N.cm (14.0 kgf.cm).

Similarly as in Embodiment 1, an operation check was performed 100 times in order to calculate the probability of disengagement between the engaging portion 6 and the apparatus shutter 8. As a result, in all the operations, a good interlocking state was ensured, i.e., disengagement was not caused to occur. Accordingly, the probability of occurrence of disengagement was 0%.

Comparative Embodiment 1

In Comparative Embodiment 1, as a material for an engaging portion 6 (of a container body 1*a*), a high-impact polystyrene (HI-PS) resin ("F5451G10", mfd. by Techno Polymer Co., Ltd.; flexural modulus: 4020 MPa) was used.

The engaging portion 6 had dimensions including a width b of 6.0 mm, a length L of a claw portion 6*b* of 16.5 mm, a thickness t of the claw portion 6*b* of 1 mm, and an angle θ of the claw portion 6*b* of 80 degrees. A depth a of engagement between the engaging portion 6 and the apparatus shutter 8 was 1.0 mm.

In the same manner as in Embodiment 1, as a result of measurement of the elastic deformation force and the release force F of the claw portion 6*b* of the engaging portion 6, the elastic deformation force P was 10.0 N (1.0 kgf) and a release force F was 4.0 N (0.4 kgf).

From the above described relationship: P=kF, k is 2.5, thus being out of the range of $0.25 \leqq k \leqq 1$.

Then, in the same manner as in Embodiment 1, as a result of measurement of a rotational torque at the time of engagement between the engaging portion 6 and the engaging portion 8 and at the time of disengagement therebetween, the rotational torque at the time of engagement was 84.3 N.cm (8.6 kgf.cm) and the rotational torque at the time of disengagement was 19.6 N.cm (2.0 kgf.cm), thus being not more than 137.3 N.cm (14.0 kgf.cm).

Similarly as in Embodiment 1, an operation check was performed 100 times in order to calculate the probability of disengagement between the engaging portion 6 and the apparatus shutter 8. As a result, disengagement of 80 times was caused to occur. Accordingly, a probability of occurrence of disengagement was 80%.

Comparative Embodiment 2

In Comparative Embodiment 2, as a material for an engaging portion 6 (of a container body 1*a*), a high-impact polystyrene (HI-PS) resin ("F5451G10", mfd. by Techno Polymer Co., Ltd.; flexural modulus: 4020 MPa) was used.

The engaging portion 6 had dimensions including a width b of 6.5 mm, a length L of a claw portion 6*b* of 16.5 mm, a thickness t of the claw portion 6*b* of 3 mm, and an angle θ of the claw portion 6*b* of 70 degrees. A depth a of engagement between the engaging portion 6 and the apparatus shutter 8 was 1 mm.

In the same manner as in Embodiment 1, as a result of measurement of elastic deformation force and the release force F of the claw portion 6*b* of the engaging portion 6, the elastic deformation force P was 17.0 N (1.7 kgf) and a release force F was 8.0 N (0.8 kgf).

From the above described relationship: P=kF, k is 2.12, thus being out of the range of $0.25 \leqq k \leqq 1$.

Then, in the same manner as in Embodiment 1, as a result of measurement of a rotational torque at the time of engagement between the engaging portion 6 and an engaging portion 8 and at the time of disengagement therebetween, the rotational torque at the time of engagement was 143.2 N.cm (14.6 kgf.cm) and rotational rotational torque at the time of disengagement was 29.4 N.cm (3.0 kgf.cm), thus exceeding 137.3 N.cm (14.0 kgf.cm) with respect to the rotational torque at the time of engagement.

Similarly as in Embodiment 1, an operation check was performed 100 times in order to calculate the probability of disengagement between the engaging portion 6 and the apparatus shutter 8. As a result, disengagement of 50 times was caused to occur. Accordingly, the probability of occurrence of disengagement was 50%.

Comparative Embodiment 3

In Comparative Embodiment 3, as a material for an engaging portion 6 (of a container body 1*a*), a high-impact polystyrene (HI-PS) resin ("Suntec-HD J310", mfd. by Asahi Kasei Chemicals Corp.; flexural modulus: 1400 MPa) was used.

The engaging portion 6 had dimensions including a width b of 4 mm, a length L of a claw portion 6*b* of 16.5 mm, a thickness t of the claw portion 6*b* of 1 mm, and an angle θ of the claw portion 6*b* of 20 degrees. A depth a of engagement between the engaging portion 6 and the apparatus shutter 8 was 2 mm.

In the same manner as in Embodiment 1, as a result of measurement of the elastic deformation force and the release force F of the claw portion 6*b* of the engaging portion 6, the elastic deformation force P was 2.0 N (0.2 kgf) and a release force F was 16.0 N (1.6 kgf).

From the above described relationship: P=kF, k is 0.13, thus being out of the range of $0.25 \leqq k \leqq 1$.

Then, in the same manner as in Embodiment 1, as a result of measurement of a rotational torque at the time of engagement between the engaging portion 6 and an engaging portion 8 and at the time of disengagement therebetween, the rotational torque at the time of engagement was 33.3 N.cm (3.4 kgf.cm) and the rotational torque at the time of disengagement was 147.1 N.cm (15.0 kgf.cm), thus exceeding 137.3 N.cm (14.0 kgf.cm) with respect to the rotational torque at the time of disengagement.

As described above, although disengagement between the engaging portion 6 and the engaging portion 8*a* was not caused to occur, the operating forces required for engagement and disengagement between the engaging portion 6 and the engaging portion 8*a* were excessively large. Therefore, the toner supply container was not practically acceptable.

Comparative Embodiment 4

In Comparative Embodiment 4, as a material for an engaging portion 6 (of a container body 1*a*), a high-impact polystyrene (HI-PS) resin ("NS130", mfd. by DS Japan; flexural modulus: 2400 MPa) was used.

The engaging portion 6 had dimensions including a width b of 5.5 mm, a length L of a claw portion 6*b* of 16.5 mm, a thickness t of the claw portion 6*b* of 1 mm, and an angle θ of the claw portion 6*b* of 10 degrees. A depth a of engagement between the engaging portion 6 and an apparatus shutter 8 was 2 mm.

In the same manner as in Embodiment 1, as a result of measurement of the elastic deformation force and the release force F of the claw portion 6*b* of the engaging portion 6, the elastic deformation force P was 6.0 N (0.6 kgf) and the release force F was 28.0 N (2.8 kgf).

From the above described relationship: P=kF, k is 0.21, thus being out of the range of $0.25 \leqq k \leqq 1$.

Then, in the same manner as in Embodiment 1, as a result of measurement of a rotational torque at the time of engagement between the engaging portion 6 and an engaging portion 8 and at the time of disengagement therebetween, the rotational torque at the time of engagement was 50.0 N.cm (5.1 kgf.cm) and the rotational torque at the time of disengagement was 186.3 N.cm (19.0 kgf.cm), thus exceeding 137.3 N.cm (14.0 kgf.cm) with respect to the rotational torque at the time of disengagement.

As described above, although disengagement between the engaging portion 6 and the engaging portion 8*a* was not caused to occur, the operating forces required for engagement and disengagement between the engaging portion 6 and the engaging portion 8*a* were excessively large. Therefore, the toner supply container was not practically acceptable.

Other Embodiments

In the above described Embodiments, all the rotational operations of the developer supply container for opening and closing the apparatus shutter 8 are performed by the operator but may also, e.g., be performed automatically by the toner receiving apparatus 7. Further, the developer supply container is mounted in the toner receiving apparatus in a direction perpendicular to the longitudinal direction of the developer supply container but may also, e.g., be mounted in the toner receiving apparatus in a direction substantially along the longitudinal direction of the developer supply container.

In the above described embodiments, the container body of the developer supply container has a cylindrical shape but may also have, e.g., a non-cylindrical shape such as a partially cut cylindrical shape or a polygonal shape.

Further, the apparatus shutter is opened and closed by rotationally moving the container body containing therein the developer, but may also be configured so that the resulting developer supply container has a double cylinder structure including an inner cylinder containing the developer and an outer cylinder provided rotatably around the inner cylinder. More specifically, the inner cylinder is provided with an opening for discharging the developer and the outer cylinder is also provided with an opening (developer discharge opening) for discharging the developer. These openings of the inner cylinder and the outer cylinder are not placed in a communication state at the time of effecting the setting operation of the developer supply container. In this state, the outer cylinder functions as the above described apparatus shutter.

At the time of mounting the developer supply container in the developer receiving apparatus, the opening of the inner cylinder is located at a position opposite to a developer receiving opening of the developer receiving apparatus. On the other hand, the opening of the outer cylinder is not opposite to the developer receiving opening and directed upward substantially vertically.

In such a state, similarly as in the above described embodiments, the setting operation of the developer supply container is performed, whereby only the outer cylinder of the developer supply container is rotated relative to the inner cylinder non-rotationally locked and fixed to the developer receiving apparatus. As a result, in association with the rotational movement of the developer supply container from the mounting position to a supply position, the opening operation of the apparatus shutter 8 is performed. Further, the opening of the outer cylinder is in a state such that it is opposite to the developer receiving opening, so that the inner cylinder opening, the outer cylinder opening, and the developer receiving opening are consequently placed in a communication state.

As for a removal (dismounting) operation of the developer supply container, re-closing operations of the inner cylinder opening and the developer receiving opening are performed in association with each other. In this case, the outer cylinder opening is left open but the inner cylinder opening is re-closed by the outer cylinder at the time of removing the developer supply container. On the other hand, the outer cylinder opening is directed upward vertically, so that an amount of scattering of the developer is very small.

In the above described embodiments, the copying machine is described as an example of the image forming apparatus but the developer supply container according to the present invention is also applicable to even image forming apparatuses such as a printer, a facsimile apparatus, a multi-functional apparatus having a plurality of functions of these apparatuses. Further, it is possible to use a color image forming apparatus in which a recording material carrying member for carrying and conveying a recording material is provided and developer images of respective colors are successively transferred onto the recording material carried on the recording material carrying member in a superposition manner. It is also possible to use a color image forming apparatus in which the above described color image forming apparatus is further provided with an intermediary transfer member onto which developer images of respective colors are successively transferred in a superposition manner and thereafter the color developer images are simultaneously transferred onto the recording material.

Further, the developer supply container of the present invention may also be configured so that it is detachably mountable to a process cartridge as a developer receiving apparatus which is detachably mountable to an image forming apparatus and it supplies developer contained therein to the process cartridge. The process cartridge at least included the developing device 201*a* and may further integrally include the electrophotographic photosensitive member 104. The process cartridge may further integrally include at least one of image forming equipment including the charger 203 and the cleaner 202.

INDUSTRIAL APPLICABILITY

As described hereinabove, according to the present invention, it is possible to properly effect opening and closing operations of a shutter by utilizing rotation of the developer supply container. Further, by the rotation of the developer supply container, it is possible to properly perform re-closure of the shutter and disengagement of the developer supply container with the shutter.

While the invention has been described with reference to the structures disclosed herein, it is not confined to the details set forth and this application is intended to cover such modifications or changes as may come within the purpose of the improvements or the scope of the following claims.

The invention claimed is:

1. A developer supply container which is detachably mountable to a developer receiving apparatus comprising a receiving opening that receives a developer and a shutter that opens and closes the receiving opening and is settable in the developer receiving apparatus by a setting operation including at least a rotation toward a setting position, said developer supply container comprising:

a snap lock portion, capable of snap lock engagement with the shutter, that opens and closes the shutter by rotation of said developer supply container, wherein when a release force required for releasing the snap lock engagement of said snap lock portion with the shutter is F(N) and an elastic repulsive force of said snap lock portion is P(N), F(N) and P(N) satisfy the following relationship:

$$P(N)=kF(N) \text{ where } 0.25 \leqq k \leqq 1.$$

2. A container according to claim 1, wherein the release force F(N) satisfies the following relationship:

$$5 \leqq F(N) \leqq 30.$$

3. A container according to claim 1, wherein the elastic repulsive force P(N) satisfies the following relationship:

$$3 \leqq P(N) \leqq 15.$$

4. A container according to claim 1, wherein the release force F(N) and the elastic repulsive force P(N) satisfy the following relationships, respectively:

$$5 \leqq F(N) \leqq 30 \text{ and } 3 \leqq P(N) \leqq 15.$$

* * * * *